US010056664B2

(12) United States Patent
Huang et al.

(10) Patent No.: US 10,056,664 B2
(45) Date of Patent: Aug. 21, 2018

(54) THREE DIMENSIONAL TUNABLE FILTERS WITH AN ABSOLUTE CONSTANT BANDWIDTH AND METHOD

(71) Applicants: Fengxi Huang, Waterloo (CA); Siamak Fouladi Azarnaminy, Waterloo (CA); Mitra Nasresfahani, Waterloo (CA); Raafat R. Mansour, Waterloo (CA)

(72) Inventors: Fengxi Huang, Waterloo (CA); Siamak Fouladi Azarnaminy, Waterloo (CA); Mitra Nasresfahani, Waterloo (CA); Raafat R. Mansour, Waterloo (CA)

( * ) Notice: Subject to any disclaimer, the term of this patent is extended or adjusted under 35 U.S.C. 154(b) by 0 days.

(21) Appl. No.: 14/828,143

(22) Filed: Aug. 17, 2015

(65) Prior Publication Data

US 2016/0049710 A1 Feb. 18, 2016

Related U.S. Application Data

(60) Provisional application No. 62/038,549, filed on Aug. 18, 2014.

(51) Int. Cl.
*H01P 1/205* (2006.01)
*H01P 7/04* (2006.01)

(52) U.S. Cl.
CPC ..... *H01P 1/2053* (2013.01); *H01P 7/04* (2013.01)

(58) Field of Classification Search
CPC ..... H01P 1/205; H01P 1/2053; H01P 1/2056; H01P 7/04; H01P 1/2084; H01P 7/10
USPC ..... 333/202, 203, 206, 222
See application file for complete search history.

(56) References Cited

U.S. PATENT DOCUMENTS

| | | | | |
|---|---|---|---|---|
| 4,292,610 A * | 9/1981 | Makimoto et al. | ..... | H01P 7/04 331/107 C |
| 6,563,401 B1 * | 5/2003 | Abbas et al. | ..... | H01P 7/10 333/202 |
| 7,205,868 B2 * | 4/2007 | Park et al. | ..... | H01P 1/2053 333/203 |
| 2004/0041661 A1 * | 3/2004 | Yamakawa et al. | .. | H01P 1/2084 333/134 |

* cited by examiner

*Primary Examiner* — Benny Lee
(74) *Attorney, Agent, or Firm* — Nasser Ashgriz; UIPatent Inc.

(57) ABSTRACT

A tunable bandpass filter to provide a constant absolute bandwidth across the entire tuning range. The filter comprises of a plurality of tunable resonators, each having an enclosure. A resonating structure extending upwardly from the bottom surface of the enclosure and a tuning screw with a flat head extending downwardly from the top surface of the enclosure, wherein the resonating structure and the flat head of the screw face each other and form a gap. The height of the tuning screw can be adjusted to change the gap between the resonating structure and the flat head. The adjustable gap of the present filter allows for tunable filter operation.

9 Claims, 11 Drawing Sheets

THREE DIMENSIONAL TUNABLE FILTERS WITH AN ABSOLUTE CONSTANT BANDWIDTH AND METHOD

RELATED APPLICATION

The present application claims the priority date of provisional U.S. patent application No. 62/038,549 filed Aug. 18, 2014.

FIELD OF THE INVENTION

The present invention relates to three dimensional (3D) microwave filters and method, and, in particular embodiments, to a tunable bandpass filter with an absolute constant bandwidth over the tuning range.

BACKGROUND OF THE INVENTION 3D resonator filters such as cavity combline, dielectric resonator and waveguide filters are widely used in wireless communication applications due to their superior performance in terms of high quality factor (Q-values) and high power handling capability. Several frequency bands are utilized simultaneously in wireless base stations to support different wireless standards. Each frequency band requires the use of bandpass filters to suppress unwanted signals and avoid the interference from adjacent bands. Using the conventional method, several bandpass filters are required to be installed in a base station to meet such requirements. Moreover, any upgrade of the network to accommodate a new standard, will require the addition of new filters to the base station. The availability of tunable/reconfigurable hardware helps to reduce the base station size by reducing the number of filter elements, it also provides the network operator the means for efficiently managing hardware resources, while accommodating multi-standards requirements and achieving network traffic/capacity optimization. Tunable filter also allows a base station to be upgraded for future wireless standards without any need for installation of new filters.

In order to minimize the number of tuning elements and to improve the loss performance of the tunable filter, it is preferable to use tuning elements only to tune the resonator center frequencies. However, the variation of inter-resonator coupling with frequency is different from that of the input/output coupling. This in turn results in deterioration of the filter return loss and changes in the filter absolute bandwidth over the tuning range. One possible solution is to add tuning elements to control the inter resonator coupling and the input/output coupling as well. In many cases, this solution may not be even feasible because of size limitation, design complexity and the inherent difficulty to tune sequential and cross inter-resonator coupling. Therefore, one needs to use only tuning elements for the resonators to tune their frequency.

This invention discloses a design method and structure of a 3D tunable bandpass filter, which avoids complex structures and provides a constant absolute bandwidth with thorough use of tuning elements only for the resonators.

SUMMARY OF THE INVENTION

In one embodiment of the present invention, a constant bandwidth tunable bandpass filter is provided. The filter comprises of tunable resonators with tuning screws or piezoelectric motors as the tuning elements. The filter also comprises of inter-resonator and input/output coupling structures that do not require any tuning elements in order to maintain an absolute constant bandwidth while tuning filter's center frequency. The tuning elements for the resonators could be based on mechanical screws, motors, Electro-Mechanical Systems MEMS, semiconductor, ferroelectric materials such Barium Strontium Titanate (BST) or any other tuning mechanism.

In another embodiment of the present invention, a method of designing a tunable bandpass filter is provided. The method comprises of forming tunable resonators with tuning screws or piezoelectric motors and a resonating structure. The method also comprises of a balanced electromagnetic coupling scheme between resonators and also input/output couplings that does not require tuning elements.

BRIEF DESCRIPTION OF THE DRAWINGS

For a complete understanding of the present invention and the design procedures, reference is now made to the following descriptions taken in conjunction with the accompanying drawing, in which.

DETAILED DESCRIPTION OF ILLUSTRATIVE EMBODIMENTS

The making and using of the present embodiments are discussed in detail below. It should be appreciated, however, that the present disclosure provides many applicable inventive concepts that can be embodied in a wide variety of specific contexts. The specific embodiments discussed are merely illustrative and do not limit the scope of the disclosure.

The present disclosure will be described with respect to a specific context, namely a wireless communications system that supports communications devices with data capability, i.e., third-generation (3G) and fourth-generation (4G) communications devices. The concepts of the present disclosure may, in general, be applied to wireless communications systems that support data capable communications devices.

Figure 1:
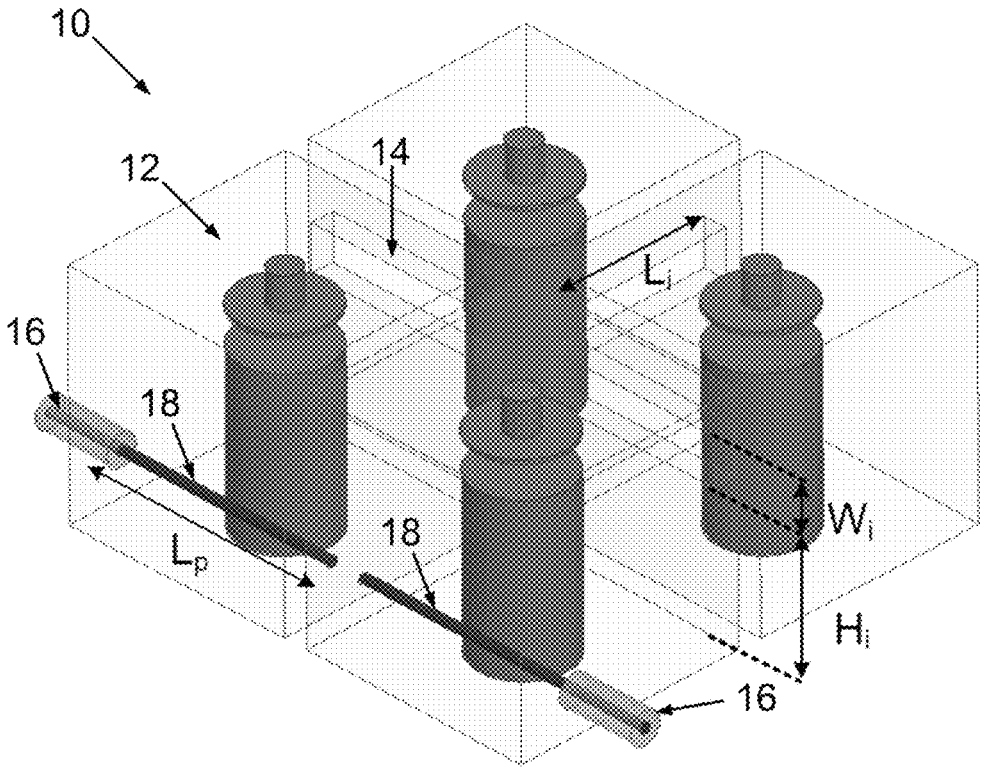
FIG. 1 is a perspective view of an embodiment of a 4-pole tunable bandpass filter.

Referring now to FIG. 1, an embodiment of a tunable bandpass filter 10 (e.g., a radio frequency (RF) front end filter) is illustrated. Tunable filter technology is an integral part of wireless base station size and cost reduction. As will be more fully explained below, the filter 10 generally permits a wireless infrastructure provider to reduce the number of filter products being managed, with less logistic management complexity. The filter 10 also enables wireless service providers to reconfigure their networks through software upgrades, including remote software upgrades. In an embodiment, the filter 10 is smaller in size and weight than traditional filter banks, yet is less expensive to produce and operate relative to conventional filters. In addition, the filter 10 has a wide tuning range and has a constant absolute bandwidth over the entire tuning range. The filter 10 is also applicable to a wide frequency range. Therefore, the filter 10 has worldwide application to many different wireless systems. The filter 10 operates over a wide tuning range while the filter bandwidth remains constant across the entire tuning range. In FIG. 1, the coupling iris between resonators has a rectangular shape of length $L_i$ and width $W_i$. The edge of the coupling iris is located from the bottom surface of the filter housing at a height $H_i$. $L_p$ is the length of the input probe 16 that provides the input coupling to the filter.

As shown in FIG. 1, the filter 10 comprises of poles or tunable resonators 12, a coupling structure 14, input/output ports 16, and input/output probes 18. In FIG. 1, the filter 10 contains four tunable resonators 12. However, in other embodiments, the filter 10 may include a plurality of tunable resonators 12 (e.g., two, three, four, five, six, or more).

The coupling structure 14 permits the tunable resonators 12 to be operably coupled to each other. In an embodiment, the coupling structure 14 is designed to provide a balanced electromagnetic coupling with a constant normalized value. The input and output ports 16 permit the filter 10 to be incorporated into a wireless communication device (e.g., a time division duplexing (TDD) base station, another type of base station employing filters, etc.) or operably connected to other telecommunications devices. By way of example, the input port 16 may be coupled to an antenna and the output port may be coupled to a power amplifier. In an embodiment, the filter 10 comprises input/output probes to provide constant input/output coupling values while the filter center frequency is tuned.

Figure 2:
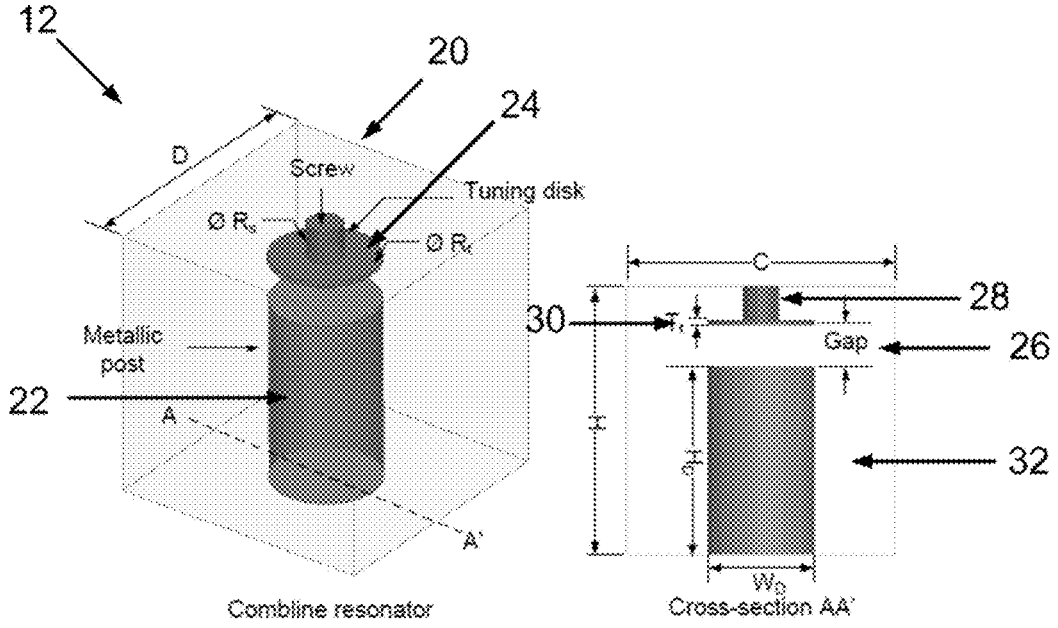
FIG. 2 is a perspective and cross section view of an embodiment of a tunable resonator employed in the filter of FIG. 1.

Referring now to FIG. 2, a cross section of one of the tunable resonators (Combline resonator) 12 from the filter 10 of FIG. 1 is illustrated. As shown, the tunable resonator 12 comprises a metallic body 20, a metallic post 22 as a resonating structure, and a tuning screw 24. The tuning screw 24 (i.e., tuning disk) comprises a vertical portion 28 and a horizontal portion 30. As shown, the horizontal portion 30 extends down into the cavity 32 and is disposed above the resonating structure 22. A gap 26 is defined between a bottom surface of the horizontal portion 30 of the tuning screw 24 and an upper surface of the resonating structure 22. The capacitance of the resonator 12 generally correlates to the capacitance provided by the gap 26. The variable height of the gap 26 allows for continuously tunable operation. FIG. 2 shows a 3 dimensional drawing and a cross-sectional view from AA' axis. In FIGS. 2, C, D and H are the dimensions of the outer conductor, which is in the form of rectangular box having an opening of dimensions C×D and a height H. $W_D$ is the diameter of the metallic post, $H_D$ is the height of the metallic post 22. $T_t$ is the thickness of the tuning disk. $ØR_s$ and $ØR_t$ are the diameters of the screw and the tuning disk, respectively.

In an embodiment, the tuning screw 24 may be manually rotated to drive the horizontal portion 30 upwardly to increase the size of the gap 26 or downwardly to decrease the size of the gap 26 in order to tune the center frequency of the filter 10. In another embodiment, the tuning screw 24 may be mechanically driven by, for example, a piezoelectric or mechanical motor, to drive the horizontal portion 30 upwardly to increase the size of the gap 26 or downwardly to decrease the size of the gap 26 in order to tune the center frequency of the filter 10. In another embodiment, the tuning screw 24 may be both manually and mechanically rotated to alter the size of the gap 26.

In an embodiment, the resonating structure 22 is a metal cylinder. In other embodiments, the resonating structure 22 may take other shapes and have other sizes in other embodiments. In an embodiment, the resonating structure 22 is formed from copper. The resonating structure 22 may be integrally formed with the body 20 of the resonator 12.

The body 20 may be formed in a variety of shapes (e.g., rectangular, square, cylindrical, polygonal, etc.) and from a variety of suitable materials such as, for example, copper. As shown, the body 20 of the tunable resonator 12 generally defines a metallic cavity 32. In an embodiment, the cavity 32 is three dimensional, which enables high power operation for base stations. In an embodiment, the body 20 of the tunable resonator 12, or some portion thereof, functions as a ground.

Figure 3:
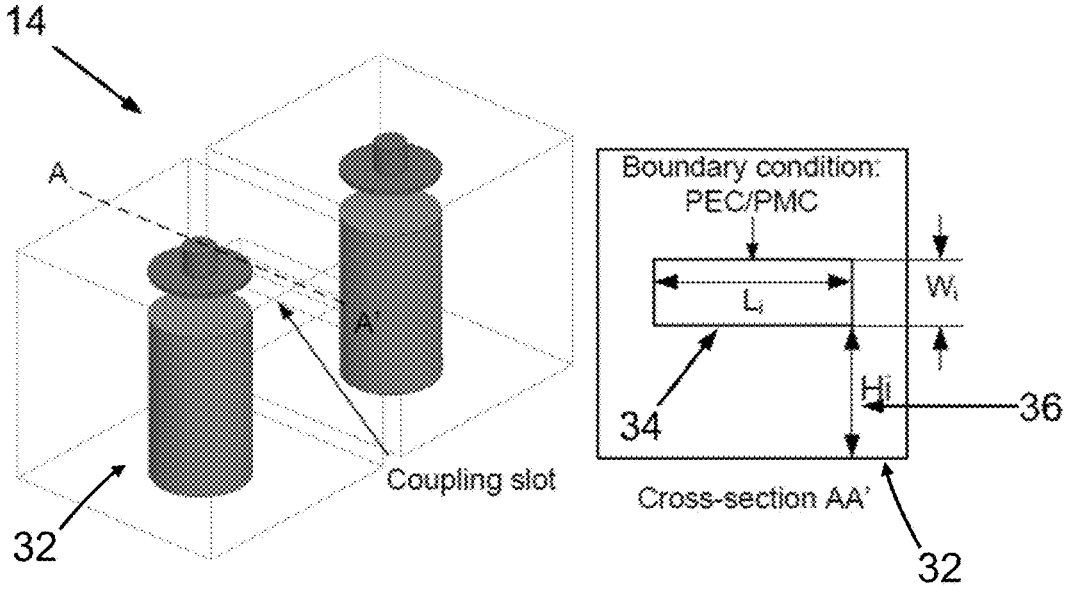
FIG. 3 is a perspective view of a pair of coupled resonators and cross section view of an embodiment of the balanced electromagnetic coupling structure between the resonators in the filter of FIG. 1.

Referring now to FIG. 3, a cross section AA', of the coupling structure 14 used in the filter 10 of FIG. 1 is illustrated. In FIG. 3, the coupling slot (the coupling iris) is the iris that is used for coupling between two adjacent resonators. It is typically referred in literature as "coupling iris" or "coupling slot". The coupling structure 14 comprises of a horizontal slot 34, having a length of $L_i$ and width of $W_i$. The height of the iris 34 from the bottom of the cavity 32, shown as $H_i$ in FIG. 3, is variable. The magnitude of the electric coupling and magnetic coupling can be adjusted by the slot height (i.e., vertical position from the bottom of cavity) 36. Therefore, by optimizing the height of the horizontal slot 36, it is possible to obtain a balanced inter-resonator coupling to maintain the normalized coupling value constant when the center frequency of the filter 10 is tuned.

The inter-resonator coupling values are extracted from electromagnetic (EM) simulation of a pair of coupled resonators in FIG. 3, using Perfect Electrical Conductor (PEC) and Perfect Magnetic Conductor (PMC) boundary conditions, as illustrated in FIG. 3. The coupled pair of resonators exhibit even and odd resonances $f_e$ and $f_m$. The physical coupling coefficient k is obtained as $$k = \frac{f_e^2 - f_m^2}{f_e^2 + f_m^2}$$

and the normalized coupling value is $$M_{ij} = \frac{f_o}{BW} k.$$

wherein $f_o$ is the filter center frequency and BW is the bandwidth. The disclosed design method in the present invention is based on using an EM optimization to find the optimum value of horizontal slot height 36 that results in a constant normalized coupling value $M_{jj}$ over the required tuning range of center frequency.

Figure 4:
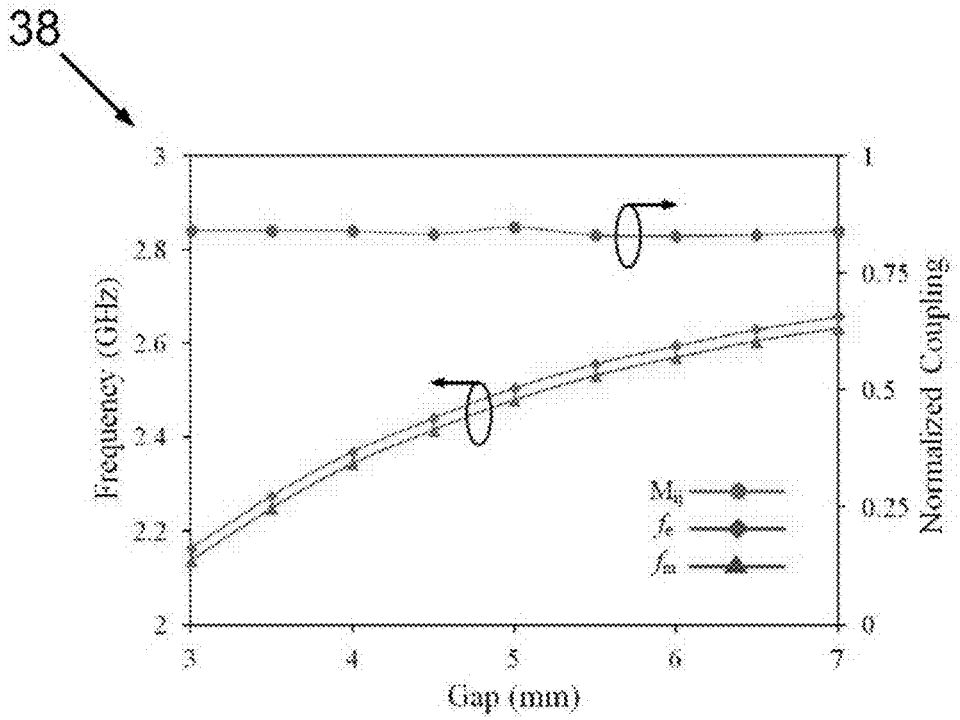
FIG. 4 is a graph illustrating tuning of the even and odd mode resonance frequencies and variations in the balanced coupling value for optimized dimensions of the coupling structure in FIG. 3.

The simulated results for an optimum coupling slot height 36 (i.e., $H_i$=17.2 mm) are graphically illustrated in FIG. 4, for a range of Gaps 26, in millimeters (mm) (as illustrated in FIG. 2). As shown in the graph 38 of FIG. 4, a constant normalized coupling value is achieved for a frequency tuning range from 2.15 GHz to 2.643 GHz (497 MHz tuning range) for this illustrative example. FIG. 4 shows the coupling value $M_{jj}$ between two adjacent resonators over a gap from 3 to 7 mm. It shows also the variation of the electric mode resonance frequency $f_e$ and the magnetic mode resonance frequency $f_m$ that are used to calculate $M_{jj}$ over the same tuning range. The two frequencies $f_e$ and $f_m$ are well defined in literature and are obtained by calculating the resonance frequency of one cavity by adding electric wall and a magnetic wall respectively at the plan AA' shown in FIG. 3.

Figure 5:
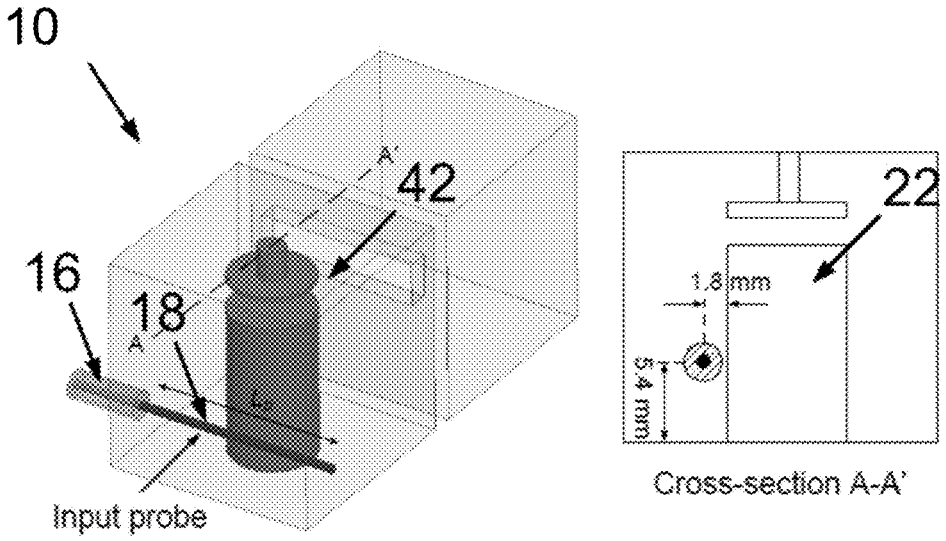
FIG. 5 is a perspective and cross section view of input/output couplings used in the filter of FIG. 1.
Figure 6:
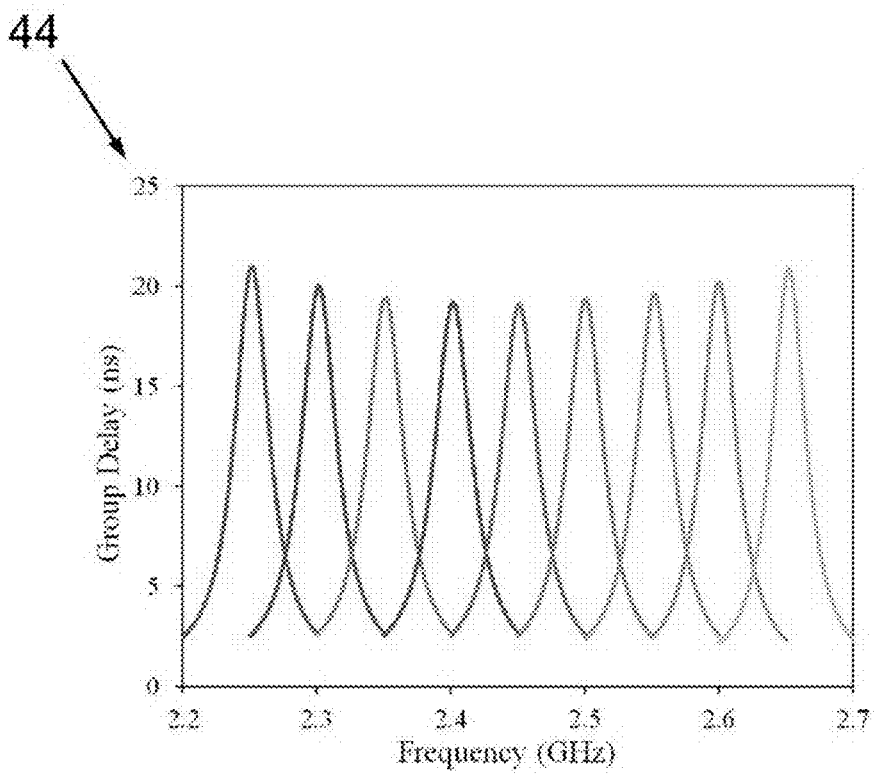
FIG. 6 is a graph illustrating variations in the group delay for an optimized length of coupling probe in FIG. 5 and when the resonance frequency of the resonator is tuned.

Referring now to FIG. 5, a perspective view and a cross-section view A-A' of the input/output couplings of the filter 10, with input port 16 and the metallic post 22 as the resonating structure, are shown. For a tunable bandpass filter, in order to have a constant absolute bandwidth, in addition to a constant normalized coupling between resonators, it is also required to have a constant normalized input impedance $$R = \frac{4}{2\pi \cdot BW \cdot \tau(f_o)}$$

where $\tau(f_o)$ is the group delay of the input/output reflection coefficients at the resonance frequency. This equation shows an inverse relation between the electrical coupling and frequency, $1/f_o$. In order to have a constant bandwidth, the maximum value of the group delay should be constant over the tuning range. The input/output coupling in FIG. 5 consists of an input probe 18 which is placed at an optimum height that maintains a constant group delay over the tuning range. The group delay is obtained using EM simulation of a first resonator 42 loaded with an input probe 18 as in FIG. 5. EM optimization is used to find the optimum value of the input/output probe length $L_p$ that results in a relatively constant group delay value over the required tuning range of center frequency. The simulated group delay over a tuning range from 2.2 GHz to 2.7 GHz (500 MHz tuning range) for an optimum probe length of $L_p$=29.3 mm is graphically illustrated in FIG. 6. FIG. 5 clearly shows that 1.8 mm is the spacing between the center of the input probe and the edge of the metallic post. The 5.4 mm is the height of the input probe from the bottom of the filter housing. FIG. 6 shows the group delay in ns of the reflected signal seen at the input probe that couples RF energy to the first resonator over the frequency range 2.2-2.7 GHz. In FIG. 6, the number 44 refers to the group delay plot, which was described above. The constant bandwidth over the tuning range can be achieved by making sure that input/output coupling $M_{jj}$ between adjacent resonators follow the behavior shown in FIG. 4, where $M_{jj}$ maintains a constant value over the tuning range. Also the group delay seen at the input or output coupling probes must maintain the same peak value over the frequency tuning range as shown in FIG. 6. The term "balanced electromagnetic coupling" refers to having electric field coupling almost equals to magnetic field coupling. This means that both electric and magnetic couplings exist between the two adjacent resonators if a coupling iris is used to couple two adjacent resonators. The magnitude of the electric field coupling can be approximately made equal to that of the magnetic field coupling (i.e. balancing) by adjusting the slot dimensions and its vertical position $H_i$. Therefore, those skilled in the art need to look at the field distribution to locate the optimum location of the iris. The exact dimensions of the coupling iris and its height can be obtained by fine tuning of these dimensions. The same can be said for the coupling provided by the input/output probes.

Figure 7:
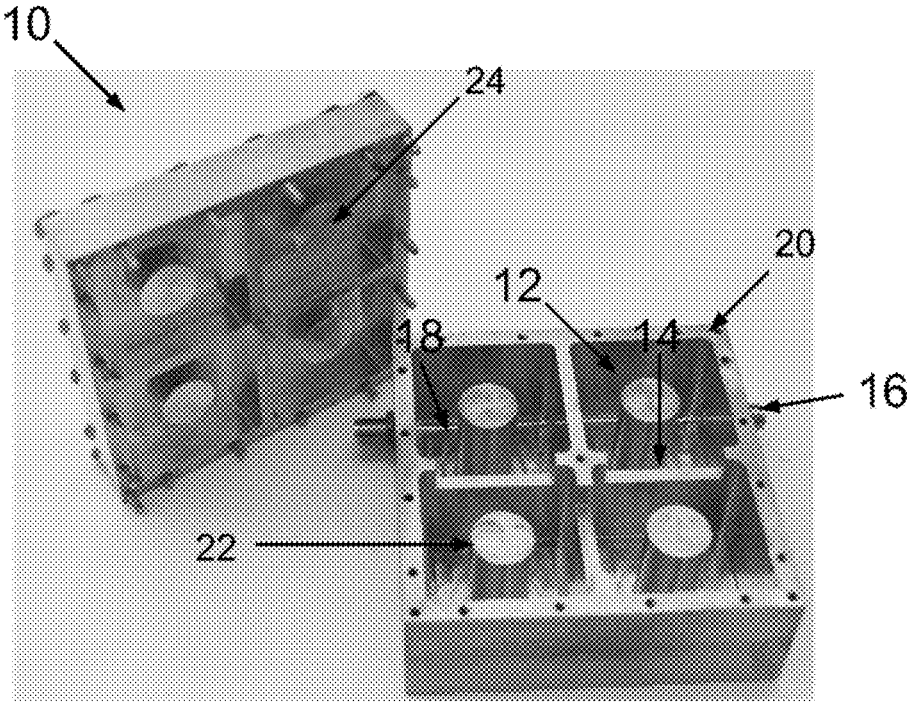
FIG. 7 is an embodiment of the four pole tunable bandpass filter with a constant bandwidth with tuning screws.
Figure 8:
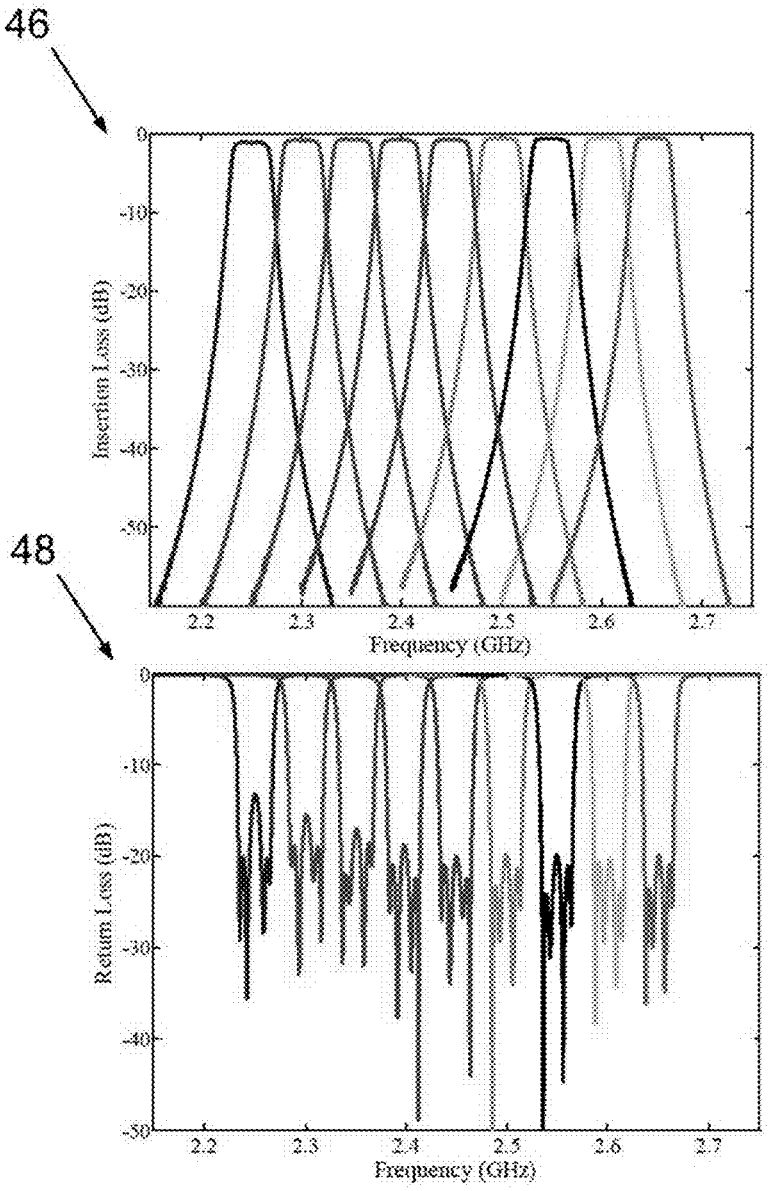
FIG. 8 is a graph illustrating measured S-parameters for an embodiment four-pole filter in FIG. 7.

As proof of concept, one of the filters 10 was constructed as shown in Figure FIG. 7. In FIG. 7, the numbers 14, 16, 18, 20 and 22 are the same numbers defined in the schematics shown in FIGS. 1 and 2. The number 16 refers to the input/output coupling probes. The number 20 refers to the outer conductor (filter housing), and the number 22 refers to the metallic post, which are shown in FIG. 7. In particular, a four-pole filter 10 was constructed using four of tunable resonators 12 coupled as noted above. In that example, the resonators 12 were formed by machining copper (i.e., the resonator body 20 was copper). In this case, the tuning screw 24 is manually rotated to adjust the center frequency of the filter 10. The measured tuning response of the filter 10 is graphically illustrated in FIG. 8 showing the measured insertion loss ($S_{11}$) in dB, the upper graph 46, and the measured return loss ($S_{21}$) in dB, the lower graph 48, in the 4-pole (having 4 resonators) tunable filter shown in FIG. 7. As shown in the graph 46 of FIG. 8, the filter 10 provided a frequency tuning range in GHz of approximately 400 MHz from about 2.25 GHz to about 2.65 GHz with an insertion loss better than 1.04 decibels (dB). The return loss as shown in the graph 48 of FIG. 8, was greater than about 15 dB for all the tuning states. The variation in the bandwidth is from 31.1 MHz to 28.9 MHz, less than ±3.7% over the entire frequency tuning range in GHz.

Figure 9:
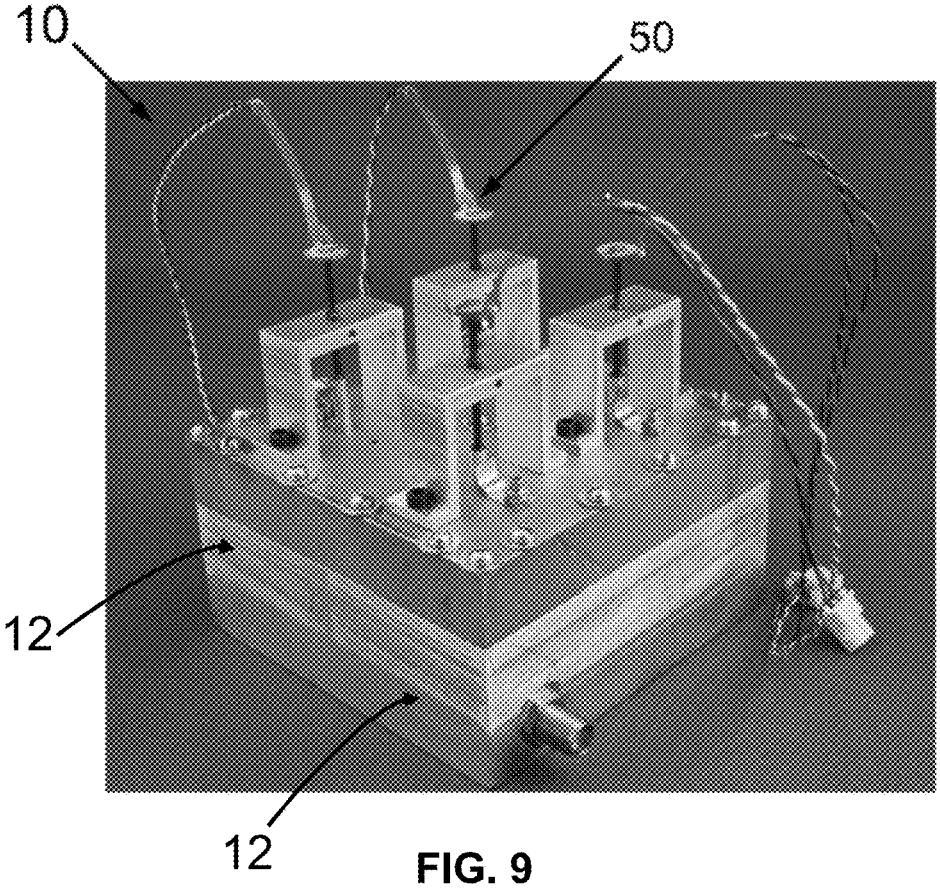
FIG. 9 is an embodiment of the four pole tunable bandpass filter with a constant bandwidth with piezoelectric motors.

As further proof of concept, another embodiment of the filters 10 was constructed as shown in FIG. 9. In particular, a four-pole filter 10 was constructed using four of tunable resonators 12 where the tuning screws were mechanically driven by piezoelectric motors 50, to tune the center frequency of the filter 10.

Figure 10:
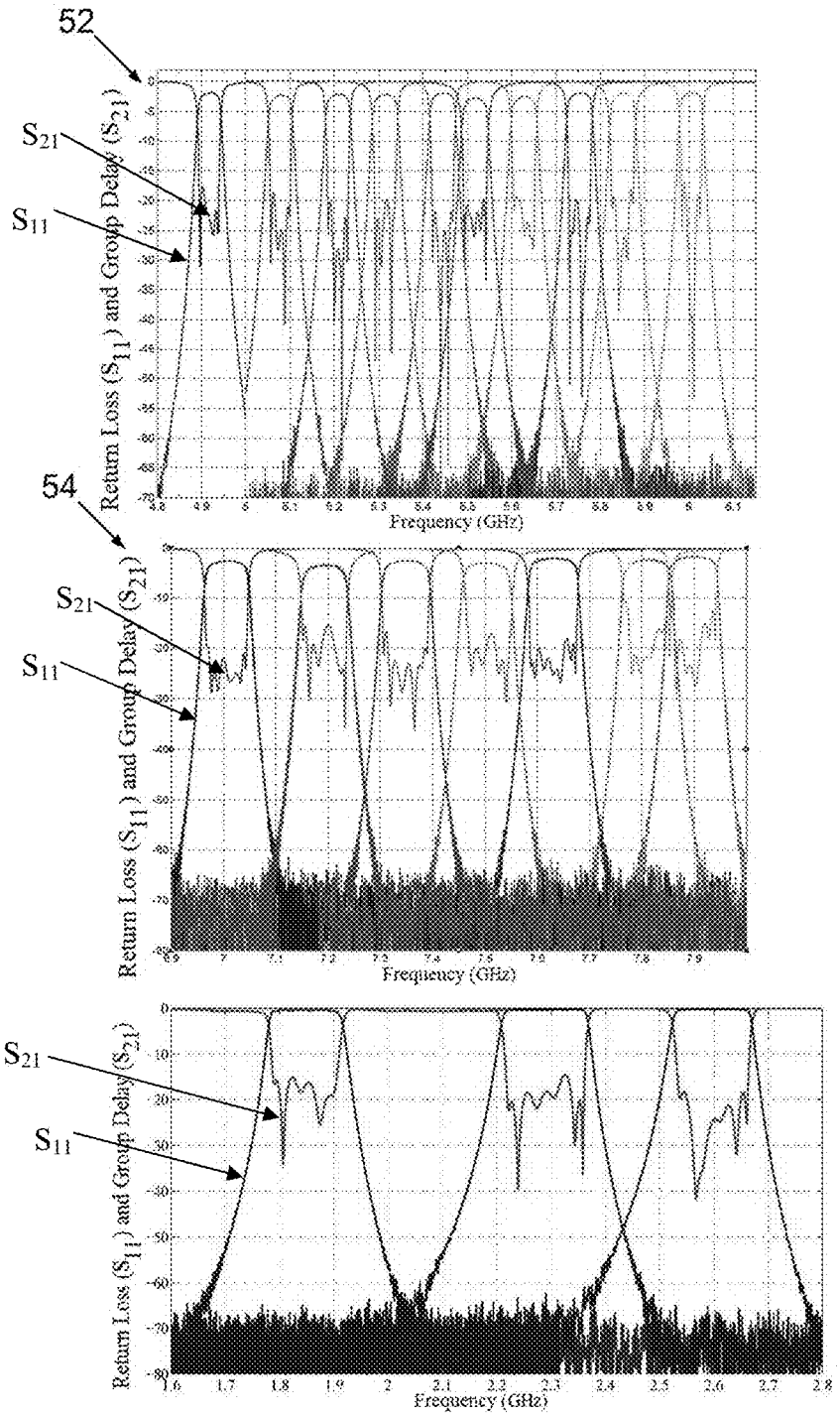
FIG. 10 is a graph illustrating measured S-parameters for an embodiment five-pole filter and for an embodiment seven-pole filter fabricated using the disclosed tunable filter design method.

Further embodiments of the filters 10 are also constructed. In particular, five-pole and seven-pole filters are constructed using the disclosed design method. The measured tuning responses of these filters are graphically illustrated in FIG. 10, which shows the measured results obtained for three filters using the same concept disclosed here. The filters have the same configuration of that shown in FIG. 7 but with more resonators. As shown in the graph 52 of FIG. 10, the five-pole filter provides a frequency tuning range in GHz of approximately 1100 MHz from about 4.89 GHz to about 6 GHz. The return loss $S_{21}$ in dB is greater than about 16 dB for all the tuning states. Also, shown is the insertion loss $S_{11}$ in dB. The variation in the bandwidth is from 44 MHz to 49 MHz, less than ±5.3% over the entire tuning range. As shown in the graph 54 of FIG. 10, the seven-pole filter provides a tuning frequency range in GHz of approximately 898 MHz from about 7 GHz to about 7.898 GHz. The return loss $S_{21}$ in dB is greater than about 14 dB for all the tuning states. Also, shown is the insertion loss $S_{11}$ in dB. The variation in the bandwidth is from 77 MHz to 88 MHz, less than ±6.7% over the entire tuning range. Another embodiment is also shown in FIG. 10 where a six-pole filter is built with a constant bandwidth over a tuning frequency range in GHz from 1.8 GHz-2.6 GHz. FIG. 10 shows the measured results obtained for three filters using the same concept disclosed here. The filters would have the same configuration of that shown in FIG. 7 but with more resonators.

Figure 11:
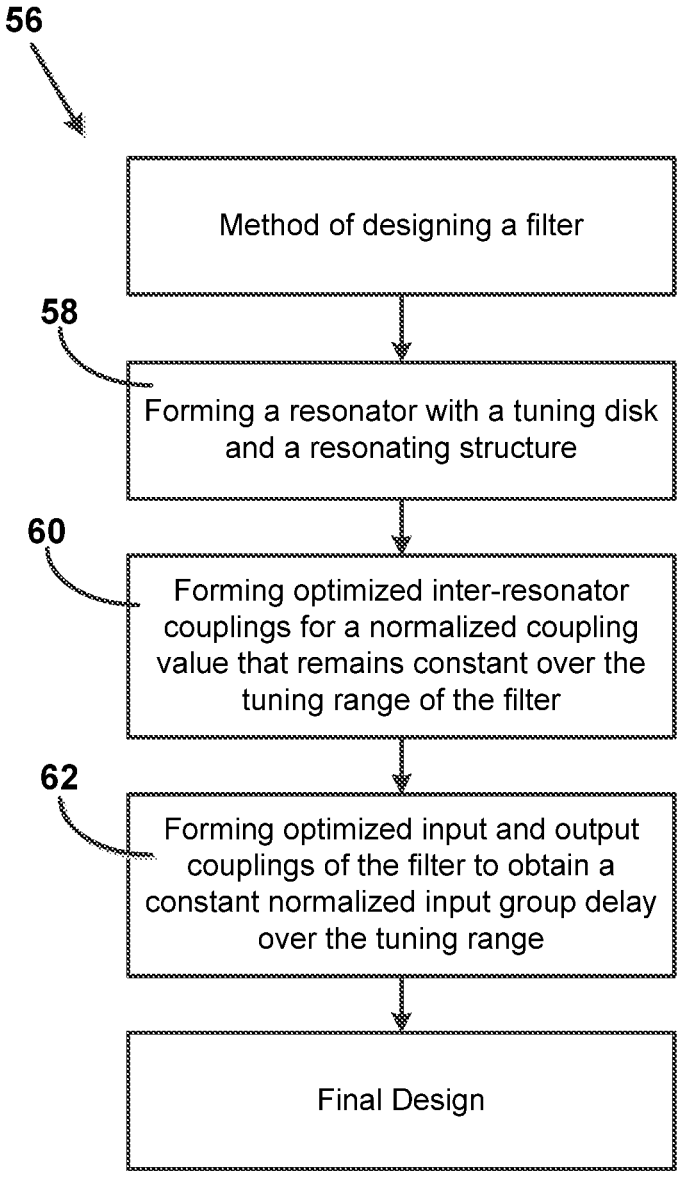
FIG. 11 is a flowchart illustrating an embodiment of a method of designing the filter of FIG. 1.

Referring now to FIG. 11, a method 56 of designing the filter is illustrated. The method 56 comprises of three steps. Step one 58, a resonator is formed with the tuning disk and the resonating structure. Step two 60, the inter-resonator coupling structures are optimized for a normalized coupling value that remains constant over the tuning range of the filter. The optimization in step two 60 is based on EM simulation for different values of the coupling slot height. Step three 62, the input and output couplings of the filter are optimized to obtain a constant normalized input group delay over the tuning range. The optimization in step three 62 is based on EM simulation for different lengths of the input/output probes results in the final design.

Although embodiments described hereinabove operate within the specifications of a cellular communication network such as a 3GPP-LTE cellular network, other wireless communication arrangements are contemplated within the broad scope of an embodiment, including WiMAX, GSM, Wi-Fi, and other wireless communication systems, including different frequency, capacitance, and filter-type specifications.

While the disclosure has been made with reference to illustrative embodiments particularly the use of mechanical tuning such as screws and motors, this description is not intended to be construed in a limiting sense. The same concept can be also applied with the use of other mechanical tuning such as MEMS tuning elements or with the use of electrical tuning elements such as semiconductor BST or phase change materials type-tuning elements. Various modifications and combinations of the illustrative embodiments, as well as other embodiments, will be apparent to persons skilled in the art upon reference to the description. It is therefore intended that the appended claims encompass any such modifications or embodiments.

What is claimed is:

1. A tunable bandpass filter to provide a constant absolute bandwidth across a tuning range, comprising:

a) a plurality of tunable resonators, each said tunable resonator having a respective tuning element and a corresponding resonating structure;

b) a plurality of coupling structures to operably couple said plurality of tunable resonators, each said coupling structure having a respective predefined shape and a corresponding predefined set of dimensions to provide the constant absolute bandwidth through having a respective electrical coupling that inversely varies with a filter center frequency, and c) a plurality of probes to provide input/output coupling having a respective set of predefined coupling-dimensions to provide the constant absolute bandwidth through having a corresponding group delay that does not vary with said filter center frequency.

2. The tunable bandpass filter of claim 1, wherein said respective tuning element is mechanically driven by a corresponding one of a piezoelectric or a mechanical motor, or a MEMS actuator to drive said respective tuning element mechanically within each said corresponding resonating structure to change a resonance frequency of said plurality of tunable resonators.

3. The tunable bandpass filter of claim 1, wherein said respective resonating structure comprising of any one of cavity combline, dielectric resonator, waveguide, micromachined silicon, substrate integrated waveguide or any other known 3D resonator configuration.

4. The tunable bandpass filter of claim 1, wherein said plurality of tunable resonators comprising of at least two adjacent tunable resonators, each said tunable resonator having a bottom-side, a top-side, and a plurality of sidewalls to form a respective cavity, said respective cavity having a cavity-shape, a cavity-height being defined as the distance between said bottom-side and said top-side, and a cavity-width being defined as the distance between a port-side-wall and an opposing-side-wall opposing said port-side-wall, and a common-side-wall being shared by said two adjacent tunable resonators.

5. The tunable bandpass filter of claim 4, wherein each said plurality of tunable resonators comprising of i) a conductive post substantially centrally located at and extending vertically upward from said bottom-side, said conductive post having a post-height, a post-diameter, and a post-end, said post-height being smaller than said cavity-height, and ii) each said tuning element substantially centrally located at and extending vertically downward from said top-side, and having a first-end extending out of said top-side and a second-end, and a conductive disk, having a disk-diameter, attached to said second-end, wherein said conductive disk directly facing said post-end and forming a gap with a gap-height being the distance between said post-end and said conductive disk, and wherein said tuning element moves in and out of said cavity to change the gap-height, whereby a capacitance of said resonator structure correlates to said gap-height, and said tunable bandpass filter tunes by changing the gap-height.

6. The tunable bandpass filter of claim 5, wherein the respective tuning element is mechanically driven by a corresponding one of a piezoelectric or a mechanical motor, or a MEMS actuator to drive said conductive disk upwardly to increase said gap-height or downwardly to decrease said gap-height in order to tune the center frequency of the tunable bandpass filter.

7. The tunable bandpass filter of claim 4, wherein each of said plurality of coupling structures being a coupling-aperture located in said common-side-wall to couple said two adjacent tunable resonators, said coupling-aperture having an aperture-shape, an aperture-size, and said coupling-aperture being located at an aperture-height from said bottom-side, whereby the magnitude of an electric coupling and a magnetic coupling between said two adjacent tunable resonators is adjusted by said aperture-size and said aperture-height.

8. The tunable bandpass filter of claim 1, wherein said respective predefined shape and said corresponding predefined set of dimensions of said respective coupling structure are determined by an electromagnetic simulation to obtain the constant absolute bandwidth for the entire designed range of the filter operating frequency.

9. The tunable bandpass filter of claim 1, wherein said respective tuning element is made of a Barium Strontium Titenate (BST) or a Phase Change Material and wherein the tuning of each said corresponding resonating structure is electrically driven.

* * * * *